US006445142B1

(12) United States Patent
Xia et al.

(10) Patent No.: US 6,445,142 B1
(45) Date of Patent: Sep. 3, 2002

(54) APPARATUS AND METHOD FOR REMOTELY DETECTING A MAGNETIC BALLAST

(75) Inventors: Yongping Xia; Yin Zhang, both of Torrance, CA (US)

(73) Assignee: Teldata Solutions LLC, Portland, OR (US)

( * ) Notice: Subject to any disclaimer, the term of this patent is extended or adjusted under 35 U.S.C. 154(b) by 0 days.

(21) Appl. No.: 09/850,984

(22) Filed: May 8, 2001

(51) Int. Cl.[7] ..... G05F 1/00; H05B 37/02
(52) U.S. Cl. ..... 315/307
(58) Field of Search ..... 315/153, 154, 315/155, 156, 157, 158, 159, 308, 324, 307, 291, 149, 150, 151, 152

(56) References Cited

U.S. PATENT DOCUMENTS 5,481,163 A * 1/1996 Nakamura et al. ..... 315/308
5,680,015 A * 10/1997 Bernitz et al. ..... 315/291
5,952,794 A * 9/1999 Bergman et al. ..... 315/307
6,094,016 A * 7/2000 Luger et al. ..... 315/295

* cited by examiner

*Primary Examiner*—Don Wong
*Assistant Examiner*—Minh D A
(74) *Attorney, Agent, or Firm*—Leydig, Voit & Mayer, Ltd.

(57) ABSTRACT

A portable, electronic device for remotely detecting and indicating whether a ballast driving a fluorescent lamp is of the magnetic type. The device comprises a power supply, a light sensor that receives emitted light from the fluorescent lamp and, in response, produces an output signal having a frequency proportional to the flicker frequency of the emitted light, a voltage detector that converts the output signal into a digital signal stream having a pulse frequency proportional to the frequency of the output signal, a microcontroller that determines whether the pulse frequency of the digital signal stream is between predetermined high and low threshold levels, wherein a first indicator signal indicating the presence of a magnetic ballast is produced as an output of the microcontroller when the pulse frequency of the digital signal stream is determined to be between the threshold levels. Until activated by a user, the microcontroller remains in a "sleep" mode, thus conserving the power supply.

19 Claims, 3 Drawing Sheets

APPARATUS AND METHOD FOR REMOTELY DETECTING A MAGNETIC BALLAST

TECHNICAL FIELD OF THE INVENTION

The present invention relates generally to ballasts used for driving fluorescent lamps, and more particularly, to a device for remotely detecting and indicating whether a ballast driving a fluorescent lamp is of the magnetic type.

BACKGROUND OF THE INVENTION

Two different types of ballasts are presently being used to drive fluorescent lamps—magnetic and electronic. A magnetic ballast serves as a current regulator that controls the power delivered to a fluorescent lamp, whereas an electronic ballast is actually an AC-AC converter. In an electronic ballast, the 120/277V alternating current (AC) input is first rectified to a direct current (DC) signal, and then is converted into a much higher frequency (e.g., above 40 KHz) AC signal to drive the lamp.

With the same input power, a fluorescent lamp can deliver more light using higher frequency input signals, which means there is higher efficiency and conservation of energy. Moreover, a lamp generates no (or substantially less) flicker with a high frequency input. Therefore, since electronic ballasts provide better light quality and save energy, they have become more and more popular, and it has become desirable to replace magnetic ballasts with electronic ballasts.

Obviously, to replace a low efficiency magnetic ballast with a high efficiency electronic ballast, one must first identify the type of ballast utilized in a fluorescent lamp fixture. Once a ballast and lamp have been installed in a fixture, it is somewhat difficult to determine the type of ballast that has been employed. Typically, this determination requires an electrician to open the cover, remove the fluorescent lamps, take off the reflector and then determine the type of ballast that is being used. A more time-efficient and cost-efficient method for determining the type of ballast employed in a fluorescent lamp fixture is desired.

BRIEF SUMMARY OF THE INVENTION

The invention provides such a method, and an apparatus for performing the method. To save both time and cost, the invention provides a means by which the type of ballast employed in a fluorescent lamp fixture can be determined remotely without disassembling or otherwise physically handling the fixture. In operation, a user simply holds the electronic device—which includes a light sensor—under the fluorescent lamp (within approximately 3–10 feet) and pushes a start-up button. Within about three seconds, the electronic components in the device determine from the flicker frequency of the light emitted by the fluorescent lamp whether the employed ballast is of the magnetic type or not. In a preferred embodiment, if the ballast is determined to be magnetic, a first (e.g., green) light-emitting diode (LED) is illuminated for about five seconds. Otherwise, a second (e.g., red) LED is illuminated.

Accordingly, one object of the present invention is to provide an electronic device for remotely detecting and indicating whether the ballast driving a fluorescent lamp is of the magnetic type or not.

Another object of the present invention is to provide such a magnetic ballast detection device that is both small in size and portable.

A still further object of the present invention is to provide such a magnetic ballast detection device that has an inactive ("sleep") mode in which the electronic components consume very little energy, thus extending the life of an on-board power supply.

In accordance with a preferred embodiment of the present invention, there is provided a portable, electronic device for remotely detecting and indicating whether a ballast driving a fluorescent lamp is of the magnetic type, the device comprising a light sensor that receives emitted light from the fluorescent lamp and, in response, produces an output signal having a frequency proportional to the flicker frequency of the emitted light; a voltage detector, electrically coupled to the light sensor, that converts the output signal into a digital signal stream having a pulse frequency proportional to the frequency of the output signal; a microcontroller, electrically coupled to the voltage detector, that determines whether the pulse frequency of the digital signal stream is between predetermined high and low threshold levels, wherein a first indicator signal indicating the presence of a magnetic ballast is produced as a first output of the microcontroller when the pulse frequency of the digital signal stream is determined to be between the threshold levels; and at least one power supply for the light sensor, the voltage detector and the microcontroller.

BRIEF DESCRIPTION OF THE DRAWINGS

The detailed description particularly refers to the accompanying figures, in which.

DETAILED DESCRIPTION OF THE INVENTION

While the invention will be described in connection with certain preferred embodiments, it will be understood that it is not intended to limit the invention to these particular embodiments. On the contrary, it is intended to cover all alternatives, modifications and equivalents included within the spirit and scope of the invention as defined by the appended claims.

As is well-known in the lighting field, the light output of a fluorescent lamp is not strictly uniform—on account of the cyclic variation in the input alternating current. The electrode discharge is extinguished each time the current cycle passes through zero, thus causing a flicker in the light output. The flicker frequency of the emitted light is proportional to the frequency of the input alternating current. This flicker effect of a fluorescent lamp is largely unnoticeable to the human eye, which is not very sensitive to fast light intensity changes when the light source remains stationary.

Figure 1:
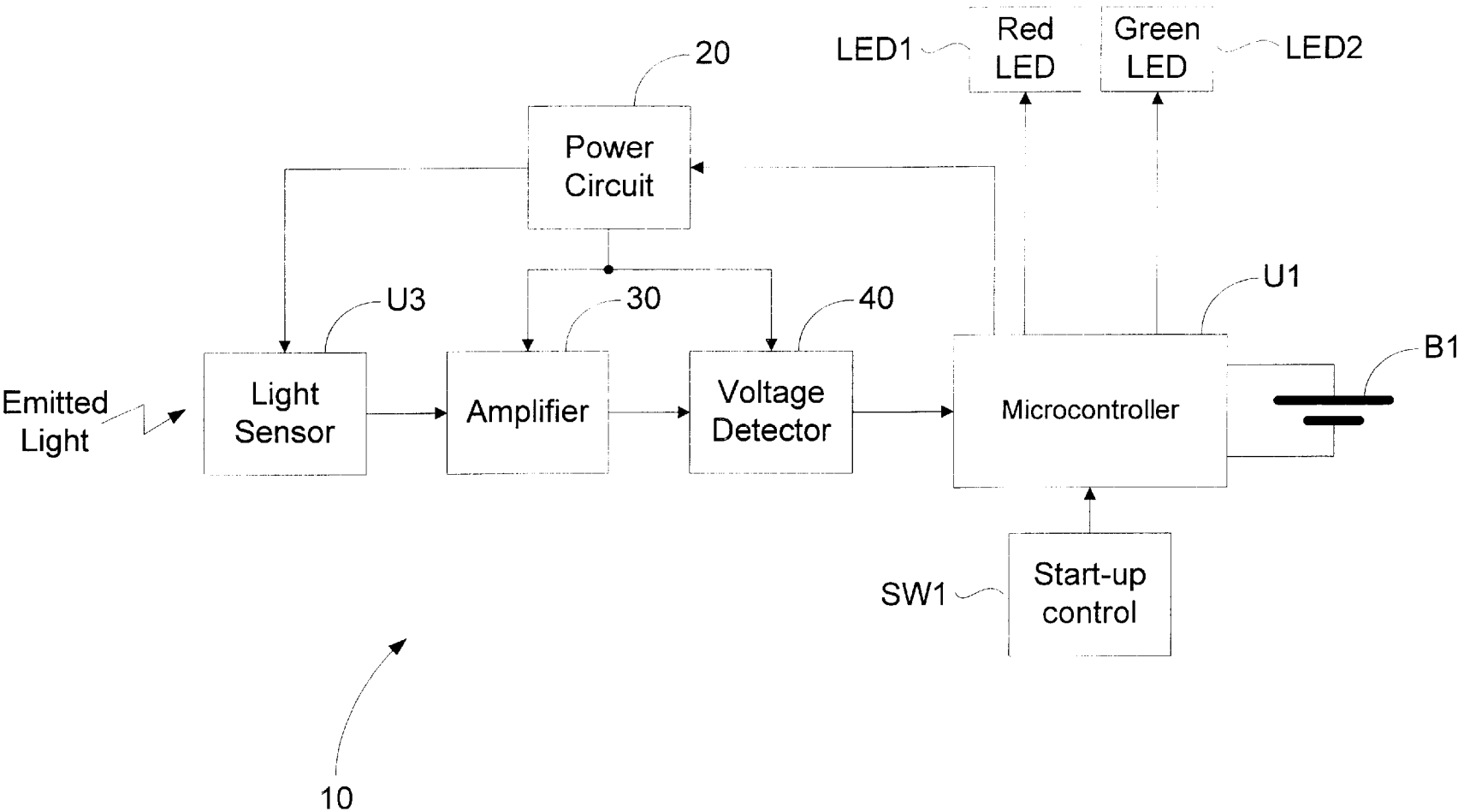
FIG. 1 is a block circuit diagram of an embodiment of the magnetic ballast detection device.

Turning now to the drawings and referring first to FIG. 1, there is shown a block circuit diagram of the magnetic ballast detection device 10 having components that are used to sense the flicker frequency of light generated by a fluorescent lamp and, in response, determine and indicate whether the ballast associated with that lamp is of the low frequency magnetic type (as opposed to a higher frequency electronic type). A microcontroller U1 controls the operation of the device 10, including the. distribution of power from a battery B1 to other components. When a user pushes a start-up control switch SW1 on the device, the microcontroller U1 changes from an inactive ("sleep") mode to an active mode and provides power from the battery to the electronic detection components in the device via a power circuit 20. A light sensor U3 is exposed to emitted light from the fluorescent lamp (not shown) and, in response, produces a weak analog AC signal that is proportional in frequency to the flicker frequency of the emitted light. This analog AC signal is amplified by an amplifier circuit 30 and passed on to a voltage detector circuit 40. In a conventional manner, the amplified analog AC signal is converted into a stream of digital signals by the voltage detector circuit, the digital signal stream having a pulse frequency that is essentially the same as the flicker frequency of the emitted light and is double the frequency of the line current passing through the fluorescent lamp. This digital signal stream is then provided to the microcontroller U1, which ultimately determines whether the pulse frequency is within a predetermined range. After receiving a predetermined duration (e.g., 3 seconds) of the digital signal stream, the microcontroller discontinues the supply of power to the power circuit 20, the light sensor U3, the amplifier 30 and the voltage detector 40, thus conserving the battery B1.

If the pulse frequency of the digital signal stream is determined to be outside the predetermined range, the microcontroller U1 produces an indicator signal on one of its output pins that briefly (e.g., for about five seconds) illuminates a first light-emitting diode LED1—thereby indicating to the user of the device 10 that the measured light is either natural light or is from a fluorescent lamp driven by a ballast that is not of the magnetic type. Conversely, if the pulse frequency is determined to be within the range, the microcontroller produces an indicator signal on another of its output pins. This indicator signal briefly illuminates a second light-emitting diode LED2—indicating to the user that the fluorescent lamp has a ballast of the magnetic type.

Figure 2:
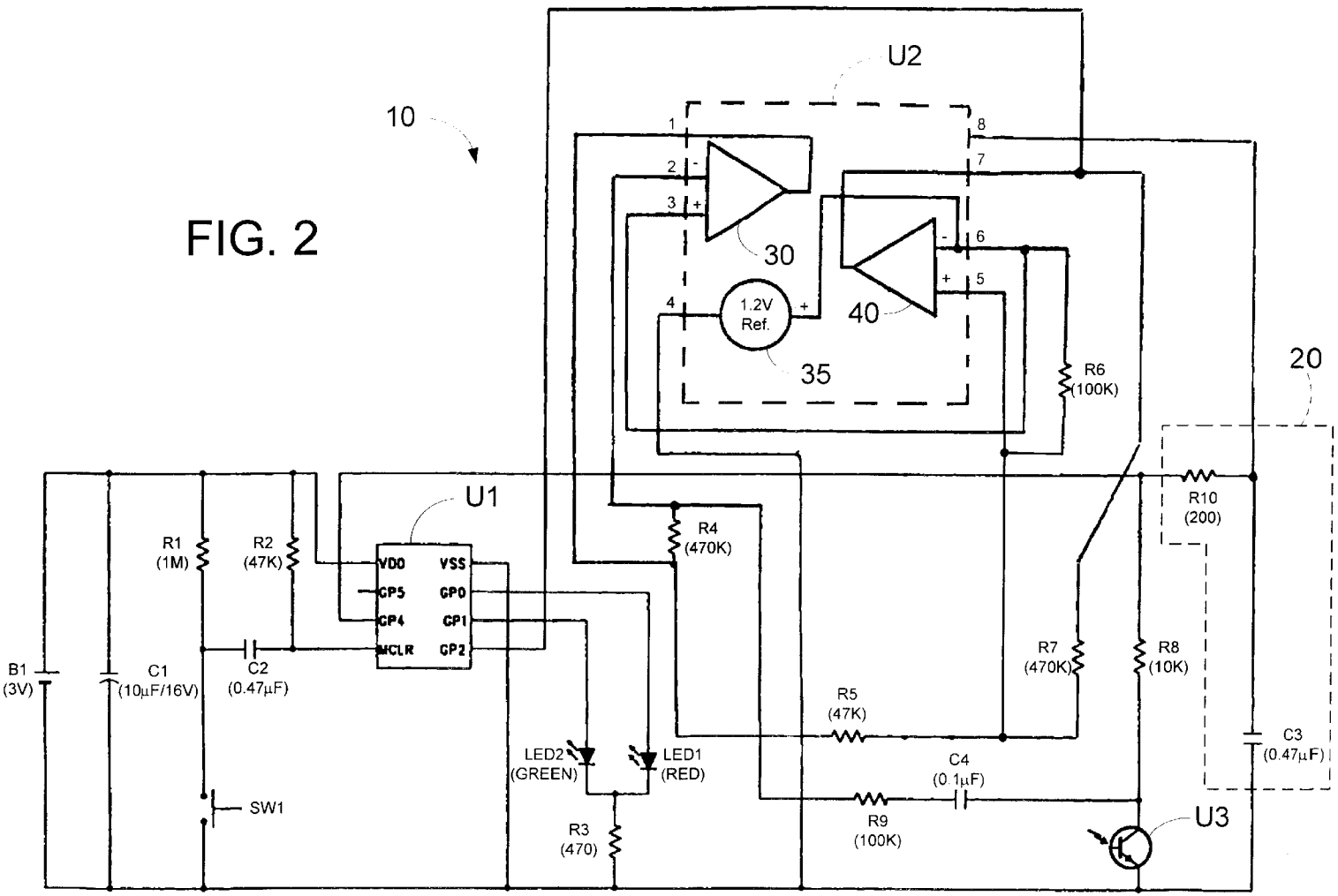
FIG. 2 is a schematic circuit diagram of an embodiment of the magnetic ballast detection device.

FIG. 2 is a detailed schematic of a preferred circuit embodiment for the invention. A light sensor U3 is provided that has a conductance proportional to the intensity of light to which it is exposed. Thus, because of flicker (i.e., light intensity fluctuations), if the light source is a magnetic ballast driven fluorescent lamp, the light sensor U3 will generate a 120 Hz AC signal for a 60 Hz power line (or a 100 Hz AC signal for a 50 Hz power line). The amplitude of this AC signal depends primarily upon the intensity of the light generated by the fluorescent lamp and the distance between the lamp and the light sensor U3. Ideally, the sensor should be held within approximately 3–10 feet of the fluorescent lamp when the invention is being used. In a preferred embodiment, the light sensor U3 is a silicon NPN phototransmitter commercially available from Vishay/Telefunken—Model BPW17N. The sensor is powered through a biasing resistor R8 that is coupled directly to a power output pin (GP4) of the microcontroller U1.

The operational amplifier 30 and the voltage detector 40 shown in FIG. 1, as well as a 1.2V reference source 35, are provided by an integrated circuit U2—for example, the MAX952ESA chip available from Maxim Integrated Products, Inc. The voltage source 35 is used both as a bias for the amplifier 30 and as a reference for the voltage detector 40. The gain of the amplifier is controlled by a pair of resistors R4, R9 coupled to it (more specifically, by the ratio of R4 over R9).

Upon activation of the device by a user (via the switch SW1), the light sensor U3 generates an analog AC signal as discussed previously. This AC signal is provided to the operational amplifier 30 through a capacitor C4 that blocks the DC drafting on the light sensor U3. The amplified AC signal output by the amplifier 30 is then provided to the voltage detector 40 via a resistor R5. Another resistor R7, coupled across the inputs and the output of the voltage detector 40, provides a positive feedback that increases the threshold. As is well-known, the higher threshold value reduces the possibility of a false detection caused by ambient noise.

The output of the voltage detector 40 (on pin 7 of the IC chip U2) is digital, and has a pulse frequency corresponding to the flicker frequency of the light emitted by the fluorescent lamp the user is investigating. For instance, if the lamp is being driven by a magnetic ballast, the pulse frequency of the digital signal stream should be either 100 Hz or 120 Hz (corresponding, respectively, to the two commonly-used power line frequencies of 50 Hz and 60 Hz).

The microcontroller U1 (for example, Model PIC12C671 available from Microchip Technology Inc.) receives the digital output of the voltage detector 40 and measures its pulse frequency. If the measured pulse frequency is determined to be between low and high threshold values (for example, 80 Hz and 144 Hz, respectively), the microcontroller concludes that the fluorescent lamp is being driven by a magnetic ballast. In that case, the microcontroller provides an indicator signal of about 5-second duration on its GP1 output pin, thus illuminating a green light-emitting diode LED2 connected thereto. On the other hand, if the measured pulse frequency of the digital signal stream is outside of the 80–144 Hz range, the microcontroller U1 concludes that the fluorescent lamp is not driven by a magnetic ballast and generates a different indicator signal (on output pin GP0) that briefly illuminates a red light-emitting diode LED1.

In accordance with an aspect of a preferred embodiment of the invention, the microcontroller U1 remains in an inactive ("sleep") mode most of the time, during which the circuitry of the entire device draws a current of less than 1 $\mu$A. Because of this extremely low current draw, no power ON/OFF switch is needed for the device.

When the user pushes the start button SW1, the charge on a capacitor C2 becomes low. This "low" signal is applied to the master clear pin (MCLR) on the microcontroller U1, thus bringing the microcontroller out of its "sleep" mode. While the microcontroller is in the active mode, power from the battery B1 is provided to the other circuit components (including the light sensor U3, the amplifier 30 and the voltage detector 40) through an output port (GP4) on the microcontroller and a power circuit 20 (comprising a resistor R10 and a capacitor C3) for a period of approximately three seconds. The "active" microcontroller U1 also measures the pulse frequency of the digital signal stream output by the voltage detector 40 and, in response, illuminates an appropriate light-emitting diode (LED1 or LELD2). The total measurement and display period (i.e., active mode period) is approximately eight seconds in duration, during which the circuitry of the device draws a current of about 2.5 mA. As will be appreciated, because of the low power consumption that the "sleep" mode facilitates, a 3V, 190 mA lithium battery would have a life of about five years under conditions in which the device were used twenty times per day and five days per week.

Figure 3:
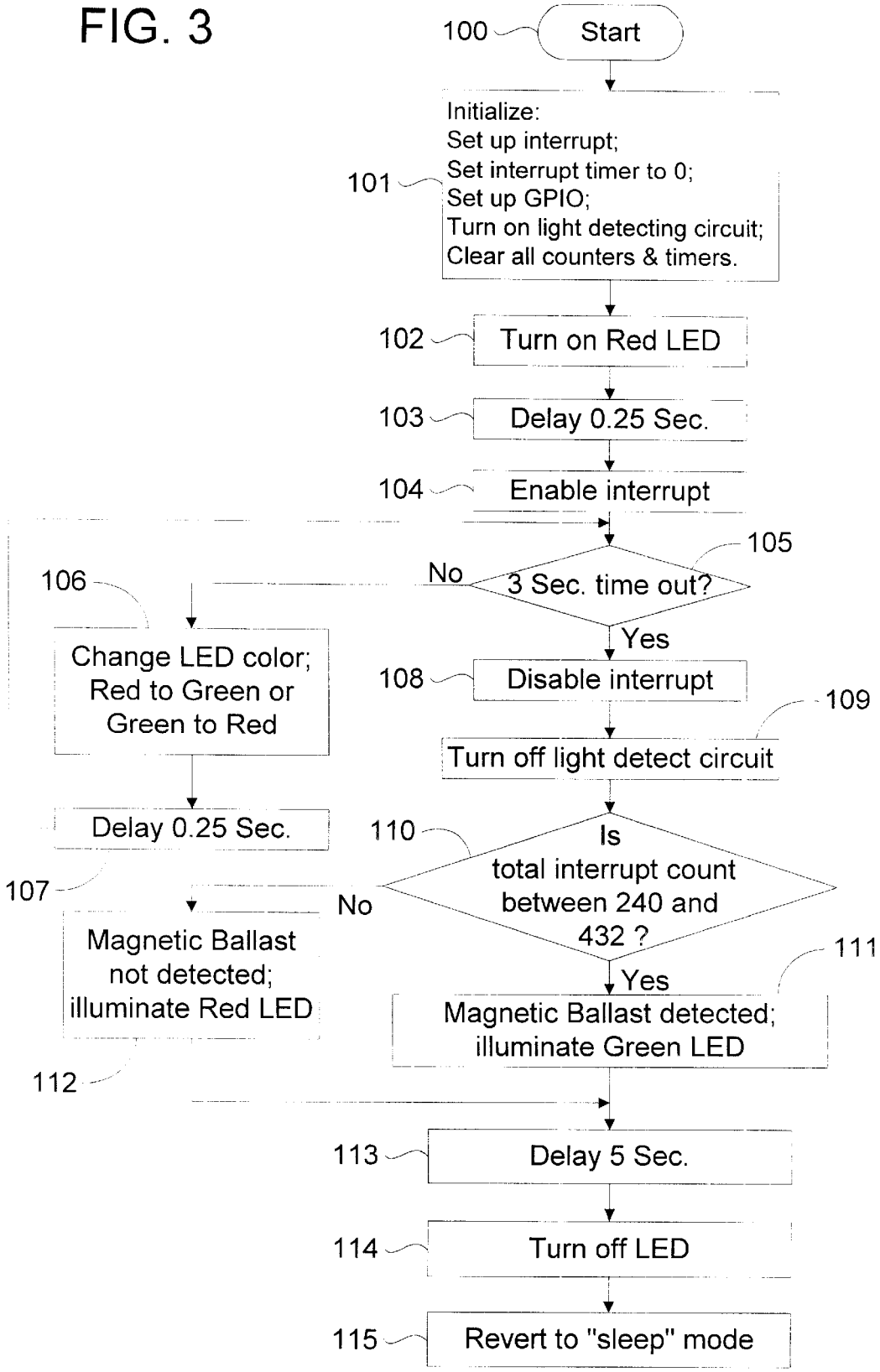
FIG. 3 is a flowchart of the firmware operation in the microcontroller U1 shown in FIG. 2.

FIG. 3 is a flowchart of the firmware utilized by the microcontroller U1 for powering the light-detecting circuit, measuring the pulse frequency of the digital signal stream output by that circuit, and illuminating an appropriate light-emitting diode (LED). As explained previously, when a user of the device pushes the start button SW1, the microcontroller U1 starts up (i.e., changes from its "sleep" mode to its active mode) (step 100). At step 101, the microcontroller conducts an initialization sequence, during which an interrupt is set up, an internal interrupt timer is set to zero, general purpose input/output ports (GP0–GP5) are set up, power from the battery B1 is provided via port GP4 to all electronic components of the light-detecting circuit, and internal counters and timers are cleared.

Following initialization, the microcontroller outputs a power signal to illuminate the red LED (step 102). After a delay of 0.25 seconds (step 103), the interrupt is enabled (step 104) and a determination is made whether the value of the internal interrupt timer has reached 3 seconds (step 105). If not, the power signal for the red LED is turned off and a power signal for the green LED is turned on (step 106). Following another delay of 0.25 seconds (step 107), the value of the internal interrupt timer is again checked (step 105). If the timer still has not reached 3 seconds, the power signal for the green LED is turned off and the red LED is again illuminated (step 106). This loop (steps 105–107) continues until the timer reaches 3 seconds—thus producing an alternating flashing sequence of the red LED and the green LED. This flashing sequence indicates to the user that the light-detecting circuit is operating.

During the 3-second period, a counter in the microcontroller U1 accumulates the input pulses (from the digital signal stream output by the voltage detector 40) by counting the number of interrupts. Once the 3-second period times out, the interrupt is disabled (step 108)—which stops the counting—and the power output port GP4 of the microcontroller is set "low"—discontinuing the provision of power to the light sensor U3, the amplifier 30 and the voltage detector 40 (step 109).

Next (step 110), the microcontroller U1 determines how many pulses were accumulated within the 3-second period. If the total interrupt count is between 240 and 432, the microcontroller recognizes that the input pulse frequency is within the 80–144 Hz range, which means that a magnetic ballast is being used to drive the fluorescent lamp. In that situation, the microcontroller outputs a power signal from its GP1 port, illuminating the green LED (step 111). On the other hand, if the total interrupt count is determined to be either less than 240 or greater than 432 (step 110), the microcontroller illuminates the red LED to indicate that the measured light is not from a fluorescent lamp driven by a ballast of the magnetic type (step 112).

In either event, after a five second delay (step 113) the illuminated LED is again turned off (step 114) and the microcontroller automatically reverts to its "sleep" mode (step 115). The microcontroller remains in this power-saving "sleep" mode until a user again pushes the start-up switch SW1.

What is claimed is:

1. An apparatus for remotely detecting and indicating whether a ballast driving a fluorescent lamp is of the magnetic type, comprising:

a light sensor that receives light emitted by the fluorescent lamp having a flicker frequency and, in response, produces an output signal having an output frequency proportional to the flicker frequency of the emitted light;

a voltage detector, electrically coupled to the light sensor, that converts the output signal into a digital signal stream having a pulse frequency proportional to the output frequency of the output signal;

a microcontroller, electrically coupled to the voltage detector, that determines whether the pulse frequency of the digital signal stream is between predetermined high and low threshold levels, wherein a first indicator signal indicating the presence of a magnetic ballast is produced as a first output of the microcontroller when the pulse frequency of the digital signal stream is determined to be between the threshold levels; and at least one power supply for the light sensor, the voltage detector and the microcontroller.

2. The apparatus of claim 1, further comprising a first light-emitting diode electrically coupled to the microcontroller, wherein the first indicator signal is used to illuminate the first light-emitting diode.

3. The apparatus of claim 1, wherein a second indicator signal indicating the absence of a magnetic ballast is produced as a second output of the microcontroller when the pulse frequency of the digital signal stream is determined to be either less than the low threshold level or greater than the high threshold level.

4. The apparatus of claim 3, further comprising a second light-emitting diode electrically coupled to the microcontroller, wherein the second indicator signal is used to illuminate the second light-emitting diode.

5. The apparatus of claim 1, further comprising an amplifier circuit, interposed between the light sensor and the voltage detector, that amplifies the output signal produced by the light sensor.

6. The apparatus of claim 1, wherein the microcontroller has an active mode of operation, in which the microcontroller provides power from the power supply to at least the light sensor and the voltage detector and determines whether the pulse frequency of the digital signal stream is between the threshold levels, and an inactive mode of operation, in which the microcontroller prevents the provision of power from the power supply to at least the light sensor and the voltage detector.

7. The apparatus of claim 6, wherein the microcontroller remains in the inactive mode until activated by a user, whereupon the microcontroller becomes active for a predetermined period of time and then automatically reverts to the inactive mode.

8. The apparatus of claim 7, wherein the predetermined period of time for the active mode of operation is approximately eight seconds.

9. A method for remotely detecting and indicating whether a ballast driving a fluorescent lamp is of the magnetic type, comprising the steps of:

sensing the flicker frequency of light emitted by the fluorescent lamp with a light sensor;

generating a digital signal stream based upon the sensed flicker frequency of the emitted light, wherein the digital signal stream has a pulse frequency proportional to the sensed flicker frequency;

determining whether the pulse frequency of the digital signal stream is between predetermined high and low threshold levels; and producing a first indicator signal indicating the presence of a magnetic ballast when the pulse frequency of the digital signal stream is determined to be between the threshold levels.

10. The method of claim 9, wherein the step of generating the digital signal stream comprises the steps of:

producing with the light sensor an output signal having an output frequency proportional to the sensed flicker frequency of the emitted light; and converting the output signal into a digital signal stream.

11. The method of claim 10, further comprising the step of amplifying the output signal before converting the output signal into a digital signal stream.

12. The method of claim 9, further comprising the step of illuminating a first light-emitting diode using the first indicator signal.

13. The method of claim 9, further comprising the step of producing a second indicator signal indicating the absence of a magnetic ballast when the pulse frequency of the digital signal stream is determined to be either less than the low threshold level or greater than the high threshold level.

14. The method of claim 13, further comprising the step of illuminating a second light-emitting diode using the second indicator signal.

15. The method of claim 9, further comprising the step of controlling the distribution of power from a power supply to the light sensor such that the light sensor only is powered for a predetermined period of time following an activation command by a user.

16. The method of claim 15, wherein the predetermined period of time the light sensor is powered is approximately three seconds.

17. An apparatus for remotely detecting and indicating whether a ballast driving a fluorescent lamp is of the magnetic type, comprising:

a light-sensing circuit that receives light emitted by the fluorescent lamp having a flicker frequency and, in response, produces an output signal having an output frequency proportional to the flicker frequency of the emitted light;

a microcontroller that receives the output signal and determines whether the output frequency of the output signal is between predetermined high and low threshold levels, wherein a first indicator signal indicating the presence of a magnetic ballast is produced by the microcontroller when the output frequency is determined to be between the threshold levels; and at least one power supply for the light-sensing circuit and the microcontroller.

18. The apparatus of claim 17, wherein the microcontroller has an active mode of operation, in which the microcontroller provides power from the power supply to the light-sensing circuit and determines whether the output frequency is between the threshold levels, and an inactive mode of operation, in which the microcontroller prevents the provision of power from the power supply to the light-sensing circuit.

19. The apparatus of claim 18, wherein the microcontroller remains in the inactive mode of operation until activated by a user, whereupon the microcontroller becomes active for a predetermined period of time and then automatically reverts to the inactive mode.

* * * * *